US009934638B2

(12) United States Patent
Blythin et al.

(10) Patent No.: US 9,934,638 B2
(45) Date of Patent: Apr. 3, 2018

(54) SINGULATING AND VALIDATING MONEY ITEMS

(71) Applicant: Crane Payment Solutions Limited, Lancashire (GB)

(72) Inventors: Robert James Blythin, Manchester (GB); Jeremy Jones, Stalybridge (GB)

(73) Assignee: Crane Payment Innovations Limited, Oldham, Lancashire (GB)

( * ) Notice: Subject to any disclaimer, the term of this patent is extended or adjusted under 35 U.S.C. 154(b) by 0 days.

(21) Appl. No.: 15/326,642

(22) PCT Filed: Jun. 29, 2015

(86) PCT No.: PCT/GB2015/051888

§ 371 (c)(1),
(2) Date: Jan. 16, 2017

(87) PCT Pub. No.: WO2016/009173

PCT Pub. Date: Jan. 21, 2016

(65) Prior Publication Data

US 2017/0206725 A1 Jul. 20, 2017

(30) Foreign Application Priority Data

Jul. 16, 2014 (GB) ..... 1412609.8

(51) Int. Cl.
*G07D 7/00* (2016.01)
*G07D 5/00* (2006.01)
*G07D 3/00* (2006.01)

(52) U.S. Cl.
CPC ..... *G07D 5/00* (2013.01); *G07D 3/00* (2013.01); *G07D 2205/00* (2013.01)

(58) Field of Classification Search
CPC ..... G07D 1/00; G07D 3/14; G07D 13/00; G07D 2201/00; G07D 3/00; G07D 3/06
USPC ..... 453/33, 34, 35, 49, 57
See application file for complete search history.

(56) References Cited

U.S. PATENT DOCUMENTS 1,749,421 A 3/1930 Donnellan
4,548,220 A 10/1985 Le Hong et al.
4,561,457 A 12/1985 Sasaki
5,017,176 A 5/1991 Swierczek
(Continued)

FOREIGN PATENT DOCUMENTS

EP 0295862 A2 12/1988
EP 1777661 A1 4/2007
(Continued)

OTHER PUBLICATIONS

Notification of Transmittal of the International Search Report and the Written Opinion of the International Searching Authority dated Sep. 28, 2015, 14 pages. PCT/GB2015/051888.
(Continued)

*Primary Examiner* — Mark J Beauchaine

(57) ABSTRACT

An apparatus comprising a money item singulator and a money item validator. The money item singulator and the money item validator may each comprise a rotatable money item conveying element. The rotatable conveying elements may rotate synchronously so that money items are singulated on the rotatable element of the singulator and fed directly to be validated on the rotatable element of the validator.

20 Claims, 9 Drawing Sheets

(56) References Cited

U.S. PATENT DOCUMENTS

| | | | | |
|---|---|---|---|---|
| 5,924,919 | A * | 7/1999 | Hirano | G07D 9/008 453/57 |
| 6,039,166 | A | 3/2000 | Abe et al. | |
| 2001/0046837 | A1 | 11/2001 | Brown et al. | |
| 2006/0278495 | A1 | 12/2006 | Umeda et al. | |
| 2008/0039004 | A1 | 2/2008 | String | |
| 2010/0072024 | A1 * | 3/2010 | O'Byrne | G07D 3/128 194/302 |
| 2010/0273409 | A1 | 10/2010 | Meyer-Steffens et al. | |

FOREIGN PATENT DOCUMENTS

| | | | |
|---|---|---|---|
| EP | 1956561 | A1 | 8/2008 |
| WO | 2009030651 | A2 | 3/2009 |

OTHER PUBLICATIONS

Search Report dated Jan. 20, 2015 in connection with British Application No. 1412609.8, 5 pages.
Search Report dated Jan. 20, 2015 in connection with British Application No. 1412609.8, 3 pages.

* cited by examiner

SINGULATING AND VALIDATING MONEY ITEMS

CROSS-REFERENCE TO RELATED APPLICATION(S)

The present application claims priority under 35 U.S.C. § 365 to International Patent Application No. PCT/GB2015/051888 filed Jun. 29, 2015, entitled "SINGULATING AND VALIDATING MONEY ITEMS", and through International Patent Application No. PCT/GB2015/051888, to British Patent Application No. 1412609.8, filed Jul. 16, 2014, each of which are incorporated herein by reference into the present disclosure as if fully set forth herein.

FIELD

This specification relates to the singulation and validation of money items. Particularly, but not exclusively, this specification relates to the singulation and validation of money items such as coins on rotatable money item conveying elements.

BACKGROUND

A money item handling system, such as a vending, gaming or other automated payment system, can include a pay-in module into which money items such as coins are first received when they enter the system. The pay-in module may be tasked with validating the money items to ensure that only acceptable money items are allowed to proceed further into the system.

A pay-in module of this type may sometimes receive money items in bulk. This makes validation of individual money items difficult unless the money items are first singulated. This problem can be exacerbated further when the money items received by the pay-in module are of different denominations and/or are from different world currencies.

SUMMARY

This specification provides a money item singulating and validating apparatus, comprising a singulator including a rotatable singulator element configured to rotate about a singulator axis to singulate money items; a transfer path through which singulated money items are fed from the rotatable element of the singulator; and a validator including a rotatable validator element configured rotate about a validator axis and to receive money items from the singulator via the transfer path and to validate the money items; the singulator axis and the validator axis being substantially aligned with one another.

The singulator axis and the validator axis may define a common axis of rotation for the singulator and validator elements.

The rotatable element of the singulator may be configured to rotate synchronously with the rotatable element of the validator.

The rotatable elements of the singulator and the validator may be fixed to the common axis of rotation.

The rotatable element of the singulator and the rotatable element of the validator may be substantially parallel to each other.

The apparatus may comprise a static element located between the rotatable element of the singulator and the rotatable element of the validator.

The rotatable element of the singulator and the rotatable element of the validator may be separated by the static element.

At least a part of the static element may be substantially parallel to the rotatable elements of the singulator and validator.

The transfer path may be provided by an aperture in the static element.

The rotatable element of the singulator may comprise at least one money item conveying region in which money items are singulated during rotation of the rotatable element of the singulator.

During a first stage of a rotation path of the conveying region, the conveying region may be configured to provide a first stable money item location in an outermost part of the conveying region.

The apparatus may comprise a guide wall located adjacent to an outer edge of the rotatable element of the singulator and the first stable location may be provided by simultaneous contact of a conveying surface of the conveying region and the guide wall with an edge of a money item.

During a second stage of the rotation path of the conveying region, the conveying region may be configured to provide a second stable money item location in an innermost part of the conveying region.

The second stable location may be provided by simultaneous contact of a conveying surface of the conveying region and a singulating surface of the conveying region with an edge of a money item.

A height of the singulating surface may not be sufficient to support the edges of two money items lying face to face in the second stage of the rotation path.

The height of the singulating surface may be between approximately 0.3 mm and 1.0 mm.

The height of the singulating surface may be between approximately 0.5 mm and 1.0 mm.

The height of the singulating surface may be between approximately 0.7 mm and 1.0 mm.

The rotatable element of the singulator may comprise at least two of the money item conveying regions, wherein the conveying regions are different in size.

A smaller of the conveying regions may be optimised to singulate money items with smaller diameters and a larger of the conveying regions may be optimised to singulate money items with larger diameters.

The conveying regions may be optimised to singulate all world coins with diameters in the range of approximately 14 mm to approximately 32.5 mm.

The rotatable element of the validator may comprise at least one money item conveying region in which money items are validated during rotation of the rotatable element of the validator.

The conveying region of the validator may be configured to receive singulated money items from a conveying region of the singulator through the transfer path.

The conveying region of the rotatable element of the validator may be aligned with the conveying region of the rotatable element of the singulator so that, during rotation of the rotatable elements, singulated money items pass from a conveying region of the singulator to the conveying region of the validator through the transfer path.

During rotation of the rotatable element of the validator, the conveying region of the validator may be configured to provide a stable money item location in an outermost part of the conveying region.

The apparatus may comprise a further guide wall located adjacent to an outer edge of the rotatable element of the validator and the stable location in the outermost part of the conveying region of the validator may be provided by simultaneous contact of a conveying surface of the conveying region and the further guide wall with an edge of a money item.

The apparatus may comprise at least one money item sensor configured to sense characteristics of money items as they are conveyed by the rotatable element of the validator.

The apparatus may comprise a controller configured to determine whether the sensed characteristics indicate that the money items are acceptable.

The apparatus may comprise a debris release aperture adjacent to the lowest point of the rotatable element of the singulator.

The apparatus may comprise a debris guide channel around the outside of the rotatable element of the singulator which guides items of debris to the debris release aperture of the singulator.

The apparatus may comprise a debris release aperture adjacent to the lowest point of the rotatable element of the validator.

The apparatus may comprise a debris guide channel around the outside of the rotatable element of the validator which guides items of debris to the debris release aperture of the validator.

The money items may comprise coins or substantially circular tokens.

This specification also provides a money item singulator comprising a rotatable money item conveying element with a circumferential surface; and a peripheral guide wall; the conveying element including: at least one money item conveying region comprising an indentation in the circumferential surface of the rotatable conveying element, the indentation including a money item conveying surface and a money item singulating surface configured to abut the edge of a money item in the conveying region, wherein: during a first stage of a rotation path of the conveying element, a first stable region for a money item is provided in an outer part of the indentation in the conveying element by the conveying surface and the peripheral guide wall, and during a second stage of the rotation path of the conveying element a second stable region for a money item is provided in an inner part of the conveying element by the singulating surface for a money item previously in the first stable position, wherein the stable region in the inner part of the conveying element supports only a single money item.

The side wall may have a region of reduced height to singulate money items during the first stage of the rotation path of the conveying element.

The singulator can include a money item collecting region to receive money items to be singulated, the conveying element being configured to pass the indentation through the money item collecting region to receive money items into the money item conveying region, and the money item conveying surface may have a height greater than that of the singulating surface to facilitate capture of money items in the conveying region from the money item collecting region.

The singulator may comprise an axis of rotation around which the rotatable conveying element is configured to rotate and the rotatable conveying element may be fixed to the axis of rotation.

The stable region for a money item in the inner part of the conveying element may be provided by simultaneous contact of the conveying surface and the singulating surface with an edge of a money item.

A height of the singulating surface may not be sufficient to support the edges of two money items lying face to face in the second stage of the rotation path.

The height of the singulating surface may be less than approximately 1.0 mm.

The height of the singulating surface may be between approximately 0.3 mm and 1.0 mm.

The height of the singulating surface may be between approximately 0.5 mm and 1.0 mm.

A height of the conveying surface may be greater than a height of the singulating surface.

A height of the conveying surface may be greater than approximately 1.5 mm and may be greater than approximately 2.0 mm.

The at least one money item conveying region may comprise at least one money item release surface for releasing surplus money items from the conveying region.

The release surface may comprise a chamfered surface which does not support money items in the conveying region.

The singulator may be configured so that during the first stage of the rotation path of the conveying element, a money item in said first stable region abuts the conveying surface to move upwardly and is urged by centrifugal force against the peripheral wall.

For the second stage of the rotation path of the conveying element, a money item in said first stable region can move to said second stable position in abutment with the conveying surface and the singulating surface such that a single money item is held in the second stable position, and if another money item is in the conveying region, it passes over the money item release surface out of the conveying region.

The conveying surface may extend inwardly into the recess and may comprise an upstanding portion disposed inwardly of the side wall, with a said money item release surface being disposed between the side wall and the upstanding portion so that money items of a diameter less than a given diameter pass over said release surface to be ejected from the recess during the first stage of the rotation path of the conveying element.

The rotatable conveying element may comprise at least two of the money item conveying regions, wherein the conveying regions are different in size.

A smaller of the conveying regions may be optimised to singulate money items with smaller diameters and a larger of the conveying regions may be optimised to singulate money items with larger diameters.

The conveying regions may be optimised to singulate all world coins with diameters in the range of approximately 14 mm to approximately 32.5 mm.

The singulator may comprise a static element located adjacent to the rotatable conveying element to support money items during conveyance by the rotatable element.

A substantially planar surface of the static element may be substantially parallel to the rotatable conveying element to support main faces of money items as the money items are conveyed by the rotatable element.

The singulator may comprise a debris release aperture adjacent to the lowest point of the rotatable element and a debris guide channel may be provided around the outside of the rotatable element, which guides items of debris to the debris release aperture.

The money items may comprise coins or substantially circular tokens.

BRIEF DESCRIPTION OF THE FIGURES

For the purposes of example only, embodiments are described below with reference to the accompanying figures in which.

DETAILED DESCRIPTION

A money item singulator 1 and a money item validator 2 for a money item handling system are illustrated in FIGS. 1 to 8. As will be described in detail below, a function of the singulator 1 is to separate money items so that each may be individually presented to the validator 2. A function of the validator 2 is to detect whether singulated money items are acceptable so that the money items can be directed into appropriate regions of the money item handling system. For example, money items which are determined as being genuine currency may be directed further into the money item handling system whereas money items which are determined as being non-genuine may be returned to the exterior of the system via a reject chute.

The singulator 1 and validator 2 may be comprised within a bulk-entry pay-in module 3, the exterior of which is illustrated in FIGS. 1 to 5. As can be seen from these figures, the exterior of the pay-in module 3 is provided by an external housing 4 which protects internal components of the pay-in module 3 such as the singulator 1 and the validator 2. The pay-in module 3 may form part of a larger money item handling system and may serve as the first point of entry for money items inserted into such a system. The pay-in module 3 may therefore receive all money items that are input to the money item handling system by users.

As described below, the pay-in module 3 is configured to feed received money items initially to the singulator 1 to be singulated.

Figure 6:
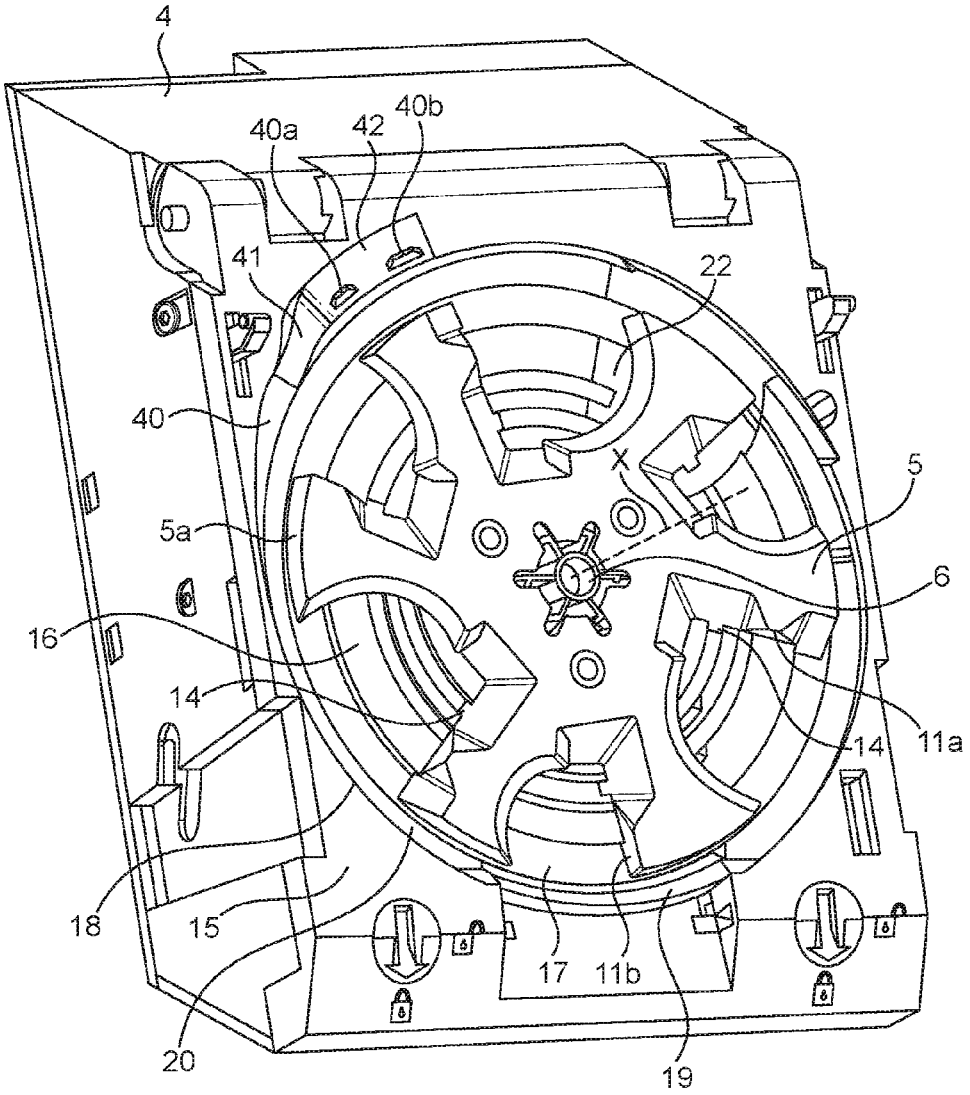
FIG. 6 is an illustration of a rotary money item singulator in a bulk entry pay-in module.
Figure 7:
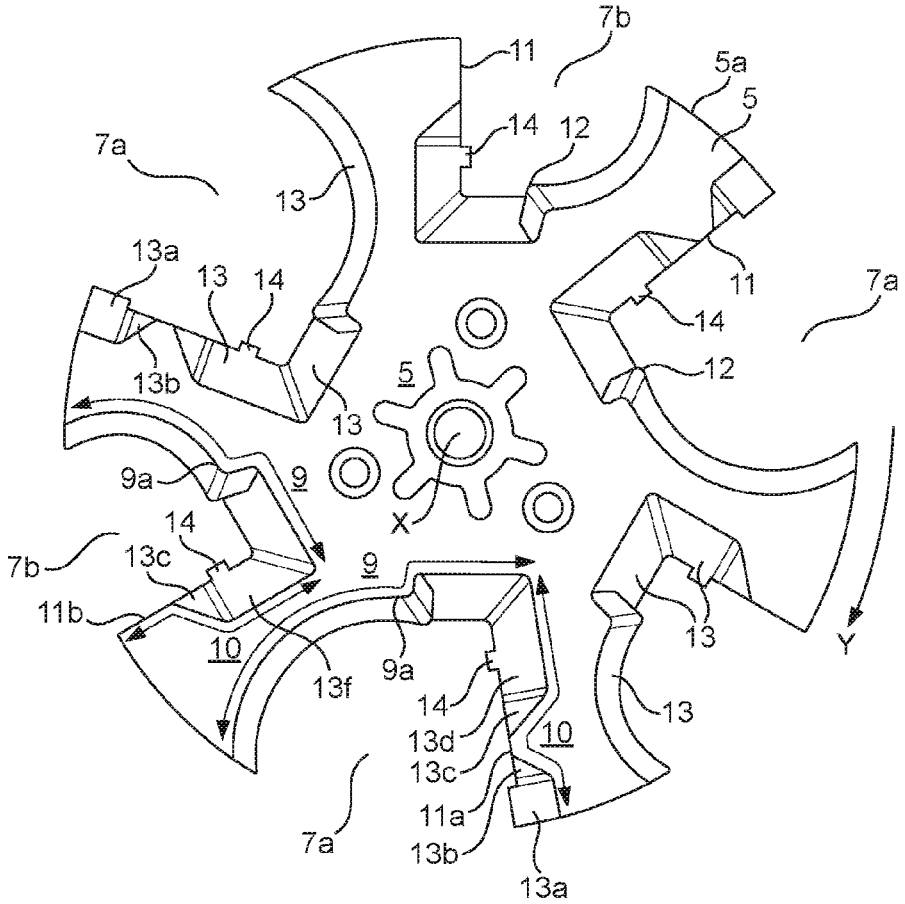
FIG. 7 is an illustration of a rotatable element of a money item singulator.
Figure 8:
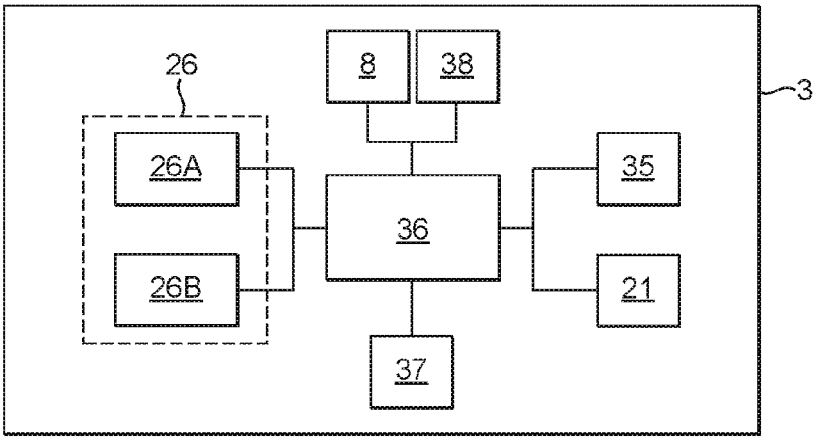
FIG. 8 is a schematic diagram of a components of a bulk-entry pay-in module.

Referring to FIGS. 6 and 7, the singulator 1 comprises a rotatable element 5 which is configured to rotate around an axis of rotation in the housing 4 to cause money items to be singulated. The rotatable singulator element 5 may be a substantially planar element, such as the rotatable plate shown in FIGS. 6 and 7, and comprises at least one money item conveying region 7 for conveying money items around the axis of rotation. As will be described below, the conveying region 7 acts to singulate the money items as they are conveyed by the rotatable element 5. The axis of rotation may, for example, comprise a driveable axle 6 rotatable by a motor about axis X, which is fixed to the rotatable singulator element 5 so that rotation of the axle 6 causes a corresponding rotation of the rotatable singulator element 5. The axle 6 may by fixed to the centre of the rotatable singulator element 5, as shown in FIG. 6. Referring to FIG. 8, rotation of the axle 6 may be driven by a drive unit 8, such as an electric motor, which may be comprised within the housing 4 of the pay-in module 3.

Referring back to FIG. 7, the rotatable element 5 may comprise a plurality of money item conveying regions 7 located around the outside of the rotatable element 5. The conveying regions 7 each comprise an indentation which is large enough to accommodate a money item in the outer periphery of the rotatable element 5. The rotatable element 5 may therefore appear to have a plurality of cut-away regions or notches around its circumference. For example, as shown in FIGS. 6 and 7, the rotatable element 5 may comprise an approximately circular plate with a plurality of conveying regions 7 provided as indentations in the otherwise circumferential peripheral surface 5*a* of the plate. The indented nature of the conveying regions 7 means that the radius of the rotatable element 5 is smaller in the conveying regions 7 than it is in other regions of the element 5.

In this example, the element 5 is configured to rotate clockwise in the direction of arrow Y and each conveying region 7 is bounded by a leading edge 9 and a trailing edge 10. In between these edges 9, 10 is the area in which a money item may reside during conveyance. The leading edge 9 is labelled in this way because it is the edge which 'leads' during rotation of the rotatable element 5.

As best illustrated in FIG. 7, the leading edge 9 and trailing edge 10 of each conveying region 7 may angle towards each other from the outer circumference 5*a* of the conveying element 5 so that they meet at the innermost part of the conveying region 7. The trailing edge 10 may extend in an approximately straight line between its innermost and outermost points, whereas the leading edge 9 may extend in an approximate arc between its innermost and outermost points. The shape of the arc may be such that the rate at which the conveying region 7 widens from its innermost point is initially high but reduces towards the outermost part of the conveying region 7.

Each conveying region 7 comprises a money item conveying surface 11 and a money item singulating surface 12 which may together support a money item in a stable position within the indentation of the conveying region 7. In this stable position, an edge of a money item located at the innermost part of the conveying region 7 is simultaneously supported by both the conveying surface 11 and the singulating surface 12 so that the money item can be conveyed around the axis of rotation 6. The conveying surface 11 of each conveying region 7 is configured to exert a driving force on an edge of a money item located against the conveying surface 11 during rotation of the rotatable element 5. This force drives the money item around the axis of rotation. In exerting the driving force, the conveying surface 11 may propel the money item upwards against gravity. This is evident from FIG. 6.

The conveying surface 11 is provided on the trailing edge 10 of the conveying region 7 and the singulating surface 12 is provided on the leading edge 9 of the conveying region 7, as shown in FIG. 7.

The rotatable element 5 includes different sizes of recess 7 for different size ranges of money items. In the example shown in FIGS. 6 and 7, two different sizes of recess 7*a* and 7*b* are shown for larger and smaller ranges of money items respectively.

Located around the recesses 7 are one or more money item release surfaces 13 which, unlike the conveying and singulating surfaces 11, 12, do not support money items in the conveying region 7 and encourage unwanted money items received in the recesses to be ejected to assist in the process of singulation, whereby each recess 7 contains a single money item.

The recesses 7*a* and 7*b* have conveying surfaces 11*a* and 11*b* that are configured to encourage money items of suitable size ranges to be stably received in the recesses. Considering the larger recess 7*a*, the conveying region 11*a* comprises an upstanding portion of the trailing edge 10 that is generally triangular in shape which is disposed radially inwardly of the outer circumferential surface of the rotary element 5 with money item release surfaces 13*a*, 13*b* being disposed on the trailing edge conveying element 5 between outer circumferential surface and the upstanding portion 11*a* so that money items of a diameter less than a given diameter passes over said release surface to be ejected from the recess 7*a* during a first stage of the rotation path of the conveying element described in more detail below. Also release surfaces 13*c*, 13*d* assist in guiding unwanted coins from the recess 7*a*.

Thus, smaller sized money items will tend not to be resident in the larger recesses 7*a* but will be received in the smaller recesses 7*b*. The conveying surface 11*b* in the recess 7*b* comprises a continuous surface that extends to release surfaces 13*e*, 13*f* which assist in the singulation process.

In the embodiments of the singulator 1, the conveying region 7 comprises a continuous release surface 13 which extends between the inner end of the conveying surface 11 and the outer end of the singulating surface 12. This is illustrated in FIG. 7, from which it can be seen that the continuous release surface 13 may extend around an approximately right-angled corner between the leading edge 9 and the trailing edge 10 at the innermost point of the conveying region 7. However, discontinuous release surfaces 13 can also be used.

The money item release surfaces 13 are shaped to cause money items to slide out of the conveying regions 7 to aid singulation. Unless they are otherwise supported, for example by contact with the conveying surface 11 and the singulating surface 12, money items whose edges contact the release surfaces 13 slide over the top of the release surfaces 13 and therefore out of the conveying region 7 during rotation of the rotatable element 5. This is described in more detail below.

In contrast to the conveying surface 11 and the singulating surface 12, which may comprise upright faces for abutting the edges of money items to support them in the conveying regions 7, the one or more release surfaces 13 may comprise chamfered surfaces which slope away from the interior of the conveying regions 7 to allow money items in the conveying regions 7 to slide over them. For example, the angle of the slope of each release surface 13 may be constant, or may vary over the length of the surface 13. For example, in an alternative to the arrangement shown in FIGS. 6 and 7 the slope of the release surface 13 which is located between the outer end of the singulating surface 12 and the outermost point of the leading edge 9 may become steeper as it extends towards the outermost point of the leading edge 9, so at a point approximately halfway along the leading edge 9, the release surface 13 ends as the slope of the release surface 13 becomes a vertical abutment for the remainder of the length of the leading edge 9.

In addition to the sloping nature of the release surfaces 13, money items may be encouraged to leave the conveying regions 7 by short, substantially flat, lifting projections 14 which extend from the bases of the release surfaces 13. Such flat projections 14 may be configured to slide under the main faces of money items in the conveying regions 7 to ensure that money items which contact the release surface 13 slide onto the release surfaces 13 and out of the conveying region 7. The projections 14 may, for example, extend from the bases of the release surfaces 13 at substantially the same sloping angle as the release surfaces 13 so that they engage a recessed track in an underlying static support surface 16 of the singulator 1. The engagement between the projections 14 and the recessed track in the static support face 16 ensures that there is no possibility of an edge of the release surface 13 abutting a money item to support the money item in the inner part of the conveying region 7. The engagement between the projection 14 and the recessed track may also help to guide the rotary element 5 as it rotates around the axis of rotation. An example of projections 14 of this type are illustrated in FIG. 7. As can be seen, the illustrated projection 14 extends from the base of the release surface 13 located between the inner end of the conveying surface 11 and the point at which the trailing edge 10 meets the leading edge 9 in the innermost part of the conveying region 7.

The singulator 1 also comprises a static element 15 which is located adjacent to the rotatable element 5. The static element 15 provides support to the main faces of money items as they are conveyed in the conveying regions 7 of the rotatable element 5. For example, as shown in FIG. 6 and referred to above, the static element 15 may comprise a planar support face 16 against which the main faces of money items rest during conveyance by the rotatable element 5. The planar support face 16 is located directly adjacent and parallel to the rotatable element 5, so that it is parallel to the main faces of money items in the conveying regions 7. As best illustrated in FIG. 6, rather than being vertical, both the support face 16 and the rotatable element 5 adjacent to it may slope backwards from a money item collecting region 17 located at the bottom of the singulator 1. The angle of the support face 16 and the rotatable element 5 relative to vertical may be between fifteen and fifty-five degrees. For example, the support face 16 and the rotatable element 5 may slope backwards from vertical at an angle of between thirty and forty degrees.

The money item collecting region 17 is located adjacent to the lowest point of the rotatable element 5 and is the region of the singulator 1 into which money items are directed when they are first inserted into the pay-in module 3. If money items are inserted into the pay-in module 3 in bulk, they may pool in the money item collecting region 17 directly in front of the lowest part of the rotatable element 5. The support face 16 is located directly behind the rotatable element 5 so that the main faces of money items collected from the collecting region 17 and accommodated in the indented conveying regions 7 of the rotatable element 5 lie against the sloping support face 16 due to gravity. The conveying surfaces 11*a*, 11*b* may be higher than the singulating surface 12 to encourage the money items to enter the recesses 7.

The static element 15 also provides support to the edges of money items as they are conveyed in the conveying regions 7 of the rotatable element 5. For example, referring to FIG. 6, the static element 15 may comprise a peripheral guide wall 18 which is approximately perpendicular to the planar support face 16. The guide wall 18 is adjacent to, and concentric with, the peripheral edge 5*a* of the rotatable element 5. The guide wall 18 curves around the peripheral edge of the rotatable element 5 so that it surrounds, or partially surrounds, the rotatable element 5. The wall 18 may be approximately circular or may, for example, be an arc of a circle. In either case, the curve of the wall 18 is centred on the same axis of rotation as the rotatable element 5 and the radius of the wall 18 is only slightly larger than the largest radius of the rotatable element 5. This means that the edges of money items located in the outermost part of each conveying region 7 are in contact with the wall 18 as they are conveyed by the conveying surface around the axis of rotation. The contact between the edges of the money items and the wall 18 guides the money items along the path of the wall 18 as the money items are conveyed by the conveying surfaces 11 of the rotatable element 5.

The static guide wall 18 and each of the conveying surfaces 11 of the rotatable element 5 may, therefore, support a respective money item in a stable location relative to the rotatable element 5 during rotation of the element 5 around the axis of rotation of axel 6. In contrast to the stable location provided by the conveying surface 11 and the singulating surface 12 for money items in the innermost part of the conveying region 7, the stable location provided by the combination of the conveying surface 11 and the guide wall 18 is for money items in the outermost part of the money item conveying region 7.

At the base of the money item collecting region 17 there may be provided a debris release aperture 19 through which small items of debris which have been inserted into the pay-in module 3 with the money items may be released. An example of the release aperture 19 is best illustrated in FIG. 6. The debris release aperture 19 may, for example, be connected to a debris exit chute or similar channel which directs items of debris out the pay-in module 3 after they have fallen through the release aperture 19 under gravity. The elimination of debris from the singulator 1 is aided by the provision of a guide channel 20 around the outside of the rotatable element 5. The guide channel 20 may be provided in the form of a small gap between the outer edge of the rotatable element 5 and the guide wall 18 of the static element 15. The guide channel 20 allows items of debris to fall to the base of the money item collecting region 17 without being continuously disturbed by rotation of the rotatable element 5. The width of the gap may be less than the radius of the smallest diameter money item to be singulated in the singulator 1. If the money items are world coins, an example gap width may, for example, be less than 7 mm, such as between 2 mm and 7 mm, because the smallest world coin presently has a diameter of approximately 14 mm.

As is evident from the discussion above, the singulator 1 provides two different stable locations in which money items can be stably conveyed in a conveying region 7 of the rotatable singulator element 5. A first of the stable locations is for a money item in the outermost part of the conveying region 7 and is provided by simultaneous contact of the conveying surface 11 and the static guide wall 18 with the edge of the money item. The second of the stable locations is for a money item in the innermost part of the conveying region 7, closer to the axis of rotation, and is provided by simultaneous contact of the conveying surface 11 and the singulating surface 12 with the edge of the money item. As will be explained below, due to the effects of gravity on money items in the conveying region 7 whilst they are being conveyed around the axis of rotation, these two locations may not be stable over the whole rotation path of the conveying region 7 and may occur at different points on the rotation path to each other. It may be the case that the two locations are not stable at the same time and that, in a particular region of the rotation path, the first location transitions from stable to unstable whilst the second location transitions from unstable to stable. Alternatively, there may be a region of the rotation path in which both locations are stable.

The effect of the stable locations on the singulation of money items by the singulator 1 is best described below in the context of a step by step operation of the singulator 1. As will be evident from the explanation below, the shape of the conveying regions 7, together with that of the static element 15, is such that only one money item can be accommodated in each conveying region 7 by the point at which the conveying region 7 reaches a particular point on its rotation path around the axis of rotation.

Figure 9:
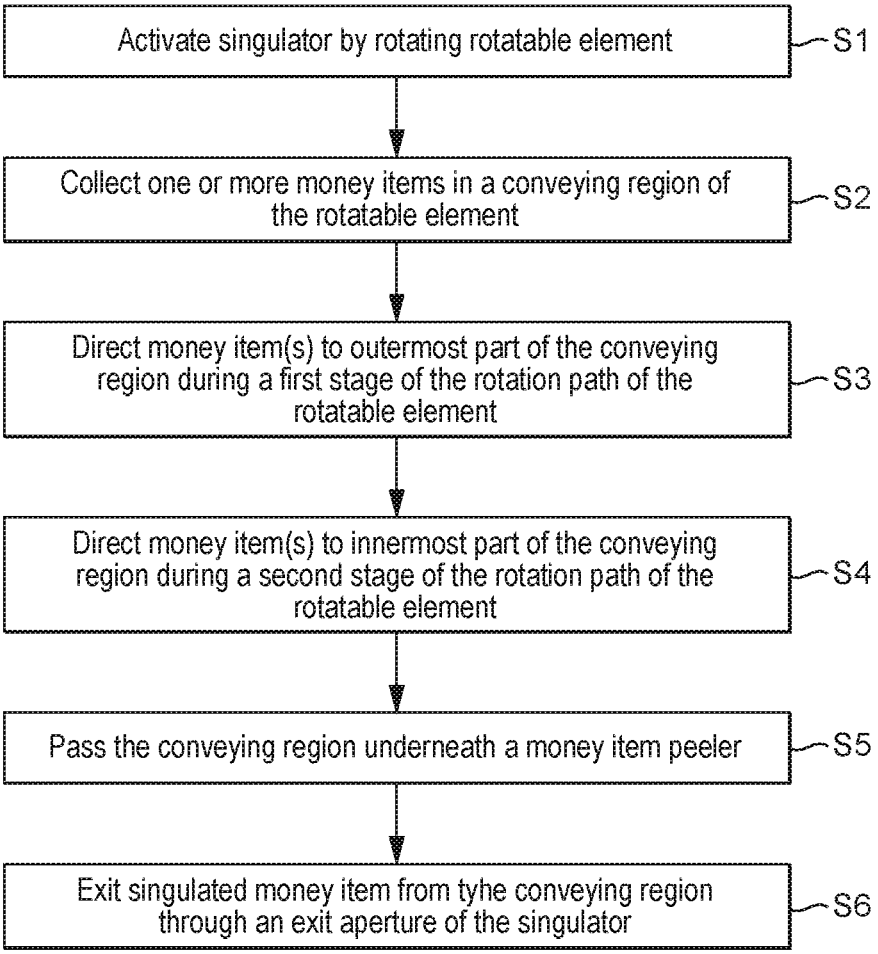
FIG. 9 is a flow diagram illustrating a set of steps for singulating money items using a rotary money item singulator.

As previously described, money items inserted into the pay-in module 3 are directed into the money item collecting region 17 of the singulator 1. The money items may be fed into the collecting region 17 by any suitable means, such as via a slot in the upper part of the pay-in module 3. In order to save power and mechanical wear, the pay-in module 3 may be configured to activate the singulator 1 only when it is detected that money items have been inserted. Otherwise, the rotatable element 5 of the singulator 1 may lie idle. Referring to FIG. 9, a first singulation step S1 may be for the singulator 1 to be activated in response to a money item detector 21, which may be located in the money item entry path of the bulk entry pay-in module 3, detecting that one or more money items has been inserted. Activation of the singulator 1 may comprise activation of the driveable axle 6 described above so that the rotatable singulator element 5 begins to rotate. The speed of rotation may be fixed and predetermined. In the example described below but without limitation, the direction of rotation is clockwise in the direction of arrow Y.

A second singulation step S2 comprises the conveying surface 11 of a conveying region 7 moving through the money item collecting region 17 and contacting the edge of at least one money item located there. The moving conveying surface 11 exerts a force against the edges of the money items to convey them forwards in a clockwise direction. Gravity ensures that the collected money items naturally locate in the outermost part of the conveying region 7 against the guide wall 18 of the static element 15.

In order to aid this money item 'pick-up' step S2, the conveying surface 11 of each conveying region 7 may have a height which is greater than the thickness of the money items to be conveyed. If the money items are coins, an example height is between approximately 3 mm and 4 mm. This increases the probability of the conveying surface 11 successfully engaging the edge of one or more money items to convey them forwards when the conveying surface 11 first contacts the edges of the money items. This is especially advantageous when there are a relatively large number of money items pooled in the collecting region 17, as in this case the conveying surface 11 may experience higher resistance to its movement and a degree of turbulence may be caused in the pool of money items.

In a third singulating step S3, the collected money items are driven forwards around the axis of rotation. Initially, at least one of the money items is located in the outermost part of the conveying region 7 in the first stable location described above. This is because the money item is forced outwards against the static wall 18 as it is conveyed by the conveying surface 11. The centrifugal force on the money item, caused by the rotation of the rotatable element 5, helps to retain the money item in the outermost part of the conveying region 7 as the conveying surface 11 moves through the first stage of its rotation path. This may, for example, comprise at least the first ninety degrees of rotation around the axle 6 from the money item collecting region 17.

In addition to the centrifugal force caused by rotation of the rotatable element 5, a money item in the outermost part of the conveying region 7 may be forced outwards against the guide wall 18 by a combination of gravity and the angle of the conveying surface 11. This further acts to retain the money item against the wall 18 in the outermost part of the conveying region 7.

The centrifugal and gravitational forces acting on money items in the conveying region 7 mean that no other part of the conveying region 7 offers a more stable location for money items during the first stage of the rotation path. Thus, during this first stage, the remaining part of the conveying region is an unstable location for money items, with the release surfaces 13 and projections 14 encouraging money items not in the stable location to slide out of the conveying region 7. This assists in preventing money items from becoming lodged side-by-side in the conveying region 7.

In addition to forcing money items to the outermost part of the conveying region 7, the centrifugal and gravitational forces acting during the first stage of the rotation path also cause any items of debris which were collected from the money item collecting region 17 to be forced towards the guide wall 18 beyond the outermost part of the conveying region 7. The items of debris are generally much smaller than the money items and therefore, unlike the money items, fall into the gap 20 between the outermost edge of the rotatable conveying element 5 and the guide wall 18. From here, the items of debris slide along the wall 18 under gravity back to the money item collecting region 17, where they may fall through the debris release aperture 19.

In a fourth singulation step S4, rotation of the rotatable element 5 causes the most stable part of the conveying region 7 to change location by migrating across the conveying surface 11 to the innermost part of the conveying region 7. This corresponds to the second of the stable locations described above, in which a money item is supported by the conveying surface 11 and the singulating surface 12. The migration of the most stable money item position to the innermost region of the conveying region 7 is caused by the decreasing ability of the conveying surface 11 to support money items in the outermost part of the conveying region 7 against gravity as the conveying region 7 moves around the axis of rotation. Once the innermost part of the conveying region 7 is lower than the outermost part of the conveying region 7, there is a tendency for money items in the outermost part to fall inwards to the innermost part. A money item may, for example, roll down the conveying surface 11 from the first stable location to the second stable location. The tendency for money items to adopt a location in the innermost part of the conveying region 7 increases as the difference in height between the outermost and innermost parts of the conveying region 7 increases during rotation of the rotatable element 5. Eventually, the centrifugal force is insufficient to prevent the gravitational force on money items in the outermost part of the conveying region 7 from causing the money items to fall inwards.

The migration of the most stable money item location to the innermost part of the conveying region 7 plays a part in the singulation process because it causes money items in the conveying region 7 to be disrupted; all of the money items fall inwards unless they are somehow otherwise supported. The shape of the conveying region 7, together with the singulating support 12, ensures that only a single money item can be supported against gravity in the innermost part of the conveying region 7, as described below.

As explained previously, in the innermost part of the conveying region 7, where the leading edge 9 meets the trailing edge 10, a money item can be stably supported by simultaneous contact with the conveying surface 11 and the singulating surface 12. In contrast to the conveying surface 11, which may have a height which is significantly greater than the thickness of the money items in order to aid 'pick-up' in the collecting region 17, the singulating surface 12 has a height which is approximately equal to or less than the thickness of the thinnest money item to be singulated in the singulator 1. If the money items are coins, an example height is less than 1 mm, such as between approximately 0.5 mm and 0.9 mm. The height of the singulating surface 12 is insufficient to simultaneously support the edges of two money items lying in face to face contact in the innermost part of the conveying region 7, meaning that the upper money item slides over the top of the lower money item and out of the conveying region 7 altogether.

Money items which leave the conveying regions 7 in this manner may fall back into the money item collecting region 17 at the bottom of the rotatable element 5, from where they may be collected by the conveying surface 11 of another conveying region 7.

An example of a scenario in which a surplus money item may be released from a conveying region 7 during the fourth step S4 of the singulation operation is described below. The scenario is described in relation to two money items that have been collected by a conveying region 7 during its passage through the collecting region 17. The money items may be different in size to each other, or may be of equal size. If the money items fall into an edge to edge configuration, one of the money items will be forced out of the conveying region 7 over one of the release surfaces 13. Alternatively, one of the money items will be forced onto the top of the other so that the money items lie face to face.

If two or more money items proceed around the first stage of the rotation path lying face to face, or partially face to face, the money items are singulated as the conveying region 7 moves into the second stage of the rotation path. In the second stage of the rotation path, as the outermost part of the conveying region 7 becomes higher than the innermost part, the money items are caused to move under gravity towards the inner part of the conveying region 7.

At this point, there are several singulation scenarios that can occur. A first of these scenarios is that the edge of one of the money items, most likely the money item that was initially closest to the planar support face 16 of the static element 15, contacts the singulating surface 12 and adopts the second stable location described above. The other of the money items slides out of the conveying region 7, either over the top of the singulating surface 12 or over one of the release surfaces 13 on either side of the singulating surface 12.

A second scenario is that the money item which is the first to contact the singulating surface 12 is too small for it to adopt the second stable location and therefore slides out of the conveying region 7 via the release surface 13 between the singulating surface 12 and the conveying surface 11. This might occur because the diameter of the money item is too small for it to simultaneously contact both the singulating surface 12 and the conveying surface 11. If this happens, the other money item might adopt the second stable location if its diameter is large enough.

As will be understood, the release surface 13 between the conveying surface 11 and the singulating surface 12 acts to release all money items whose diameters are not large enough to be retained in the first stable location. This might occur equally in both of the first and second stages of the rotation path.

Another possibility is for surplus money items to be forced over one of the release surfaces 13 by contact with the guide wall 18. For example, if a money item is too large to fit within the available space of the conveying region 7, either because it is already occupied by another money item or because the money item has a diameter which is larger than can be accommodated by the area between the leading and trailing edges 9, 10 of the conveying region 7, contact with the guide wall 18 may force the opposite side of the money item up onto one of the release surfaces 13. This will cause the money item to slide over the release surface 13 during the second stage of the rotation path. As best illustrated in FIG. 7, in order to accommodate and singulate all sizes of money items, such as all world coins or all coins within a particular currency, the plurality of conveying regions 7 in the rotatable element 5 may be different in size. For example, FIG. 7 illustrates a rotatable element 5 in which two different sizes and shapes of conveying region 7 are provided. In these different conveying regions, the distance between the innermost end of the conveying surface 11 and the innermost end of the singulating surface 12 is different in order to account for money items with different diameters.

A further singulation scenario may involve a singulating region 40 of the peripheral guide wall 18. In general, the height of the guide wall 18 may be approximately 3 mm to 5 mm so as to provide a reliable abutting surface for money items in the conveying regions 7. However, in a singulating region 40 of the guide wall 18, the height of the wall 18 ramps downwardly so as to be significantly reduced and is not high enough to abut two money items lying face to face in a conveying region 7. An example height of the singulating region 40 of the guide wall 18 may be approximately equal to or less than the thickness of the thinnest money item to be singulated in the singulator 1. If the money items are coins, an example height is less than 1 mm, such as between approximately 0.5 mm and 0.9 mm. It will be appreciated that, as the height of the singulating region 40 of the wall 18 is insufficient to simultaneously support the edges of two money items lying in face to face contact, the gravitational and/or centrifugal forces on the upper of the two money items will cause the upper money item to slide over the top of the lower money item and out of the conveying region 7 altogether. The guide wall 18 ramps upwardly from the singulating region 40 in upwardly ramped region 41 to a raised portion 42 provided with upstanding pegs 40*a*, 40*b* that may be provided to assist in the singulation process by toppling an overlying money item back into the interior of the module 3. It will be appreciated that this singulation occurs towards the end of the first stage of the rotation path of the conveying element 5.

Figure 10:
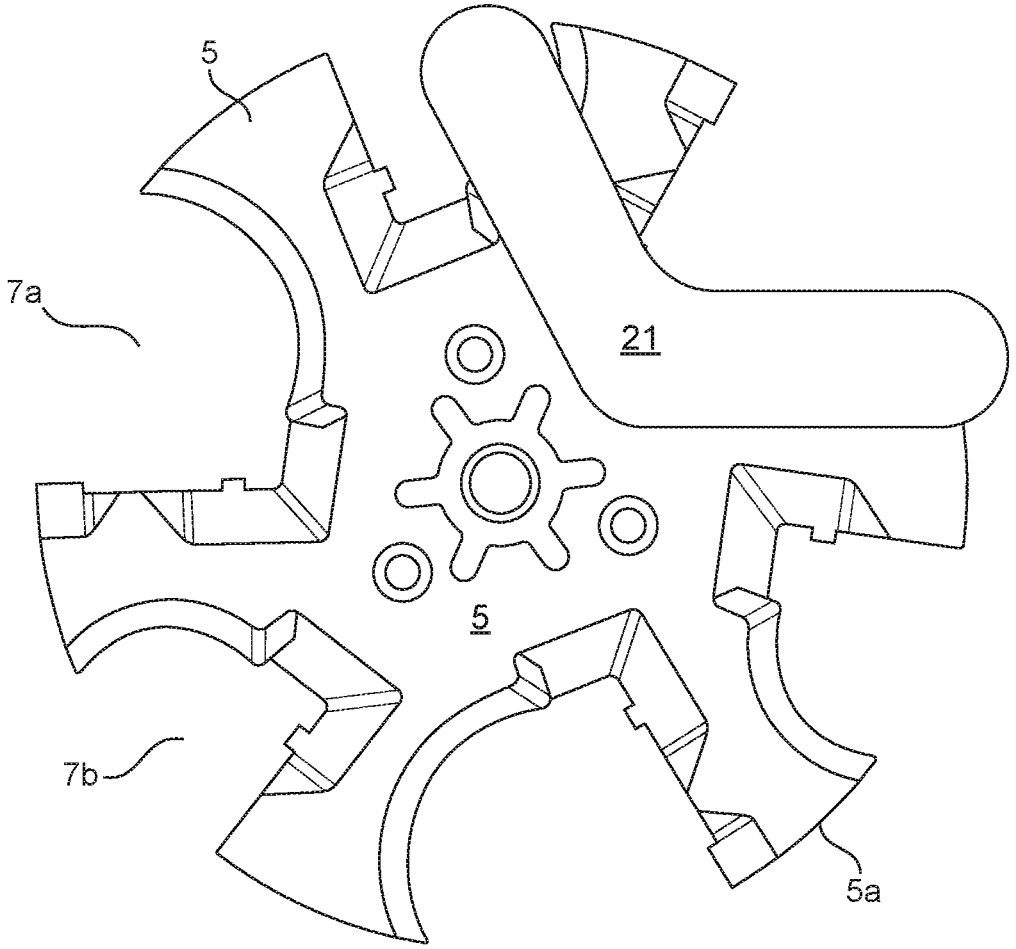
FIG. 10 is an illustration of a rotatable element of a money item singulator and a peeler arm for removing surplus money items.

In a fifth singulation step S5, rotation of the rotatable element 5 may cause the conveying region 7 to pass beneath an optional money item peeler 21. The peeler 21 is configured to ensure that any money items which are not lying flat against the planar support surface 16 inside the conveying regions 7 are directed back into the collecting region 17. Referring to FIG. 10, the peeler 21 may, for example, comprise a static arm which extends over the radius of the rotatable element 5 at a fixed point in the second stage of the rotation path. A lower surface of the peeler 21 runs adjacent and parallel to the front surface of the rotatable element 5 on the opposite side of the rotatable element 5 to the planar support face 16. The distance between the surface of the peeler 21 and the front of the rotatable element 5 is less than the thickness of the thinnest money item to be singulated. An example distance is less than 1 mm, such as less than 0.5 mm. This means that if any part of a money item is above the top of the leading or trailing edges 9, 10 it will strike the peeler 21. Contact with the peeler 21 will either knock the money item out of the conveying region 7, or knock the money item into the second stable location inside the conveying region 7. Although not illustrated in FIG. 7, the peeler 21 may be fixed at either end to the static element 15 of the singulator 1.

In a sixth singulation step S6, the single remaining money item in the conveying region 7, which is supported by the conveying surface 11 and the singulating surface 12 in the second stable location, is conveyed to an exit region 22. The exit region 22 may comprise an aperture in the support face 16 of the static element 15 through which the singulated money item exits the singulator 1. The aperture provides a transfer path to the validator 2 and may, for example, comprise a slot which leads to the validator 2.

Figure 11:
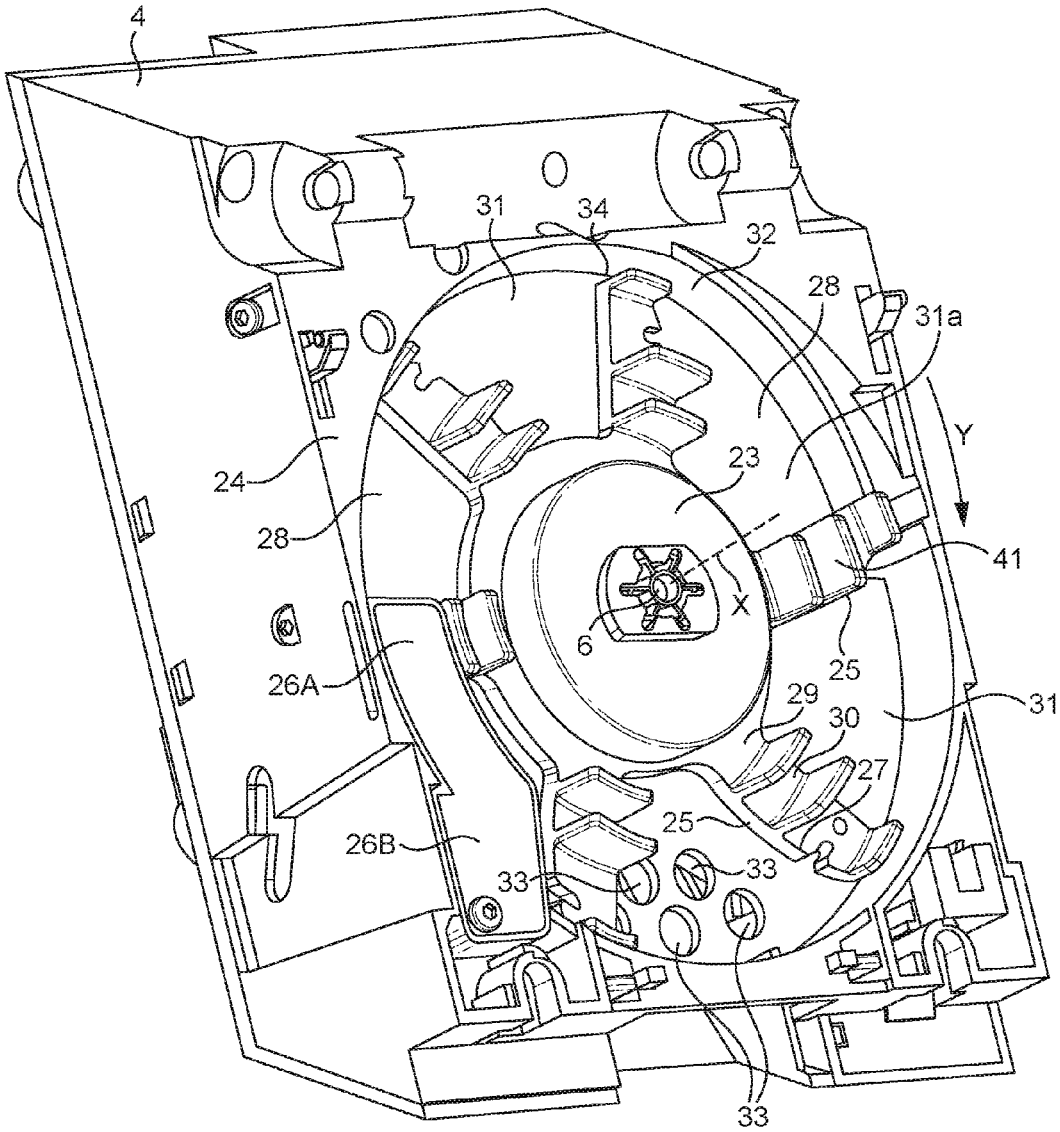
FIG. 11 is an illustration of a rotary money item validator in a bulk entry pay-in module.

As with the singulator 1 described above, the validator 2 comprises a rotatable element 23 and a static element 24. The rotatable element 23 comprises a plurality of money item conveying surfaces 25 which are configured to convey singulated money items received from the singulator 1 past one or more money item sensors 26 to validate the money items. Referring to FIG. 11, the money item conveying surfaces 25 may be provided on the trailing edges 27 of a plurality of money item conveying regions 28 of the rotatable element 23. For example, the rotatable element 23 may comprise a plurality of arms 29 which extend outwards from the centre of the rotatable element 23 to define the conveying regions 28. The trailing edge 27 of each conveying region 28 corresponds to the longitudinal edge of an arm 29. The opposite longitudinal edge of the arm 29 defines the leading edge 30 of the following conveying region 28.

The arms 29 meet in the centre of the rotatable element 23, which is fixed to the same driveable axis of rotation as the rotatable singulator element 5 described above. The rotatable element 23 of the validator 2 may therefore rotate synchronously with the rotatable element 5 of the singulator 1. Thus, the rotatable validator element 23 is configured to rotate about a validator axis and the singulator element 23 is configured to rotate about a singulator axis which is substantially aligned with the validator axis. The singulator axis and the validator axis may define a common axis of rotation X for the singulator and validator elements 5, 23 as shown in the drawings, but they may not necessarily be aligned exactly to define a common axis. For example, the singulator axis may be inclined at up to 10° to the validator axis and the singulator axis may be displaced laterally from the validator axis by up to 10% of the largest radius of the rotatable validator element 23.

Referring back to FIG. 5, the rotatable validator element 23 of the validator 2 may be located on the opposite side of the planar support face 16 to the rotatable singulator element 5 of the singulator 1. It is not possible for money items to pass from the singulator 1 to the validator 2 other than through the aperture in the exit region 22 described above and shown in FIG. 6. The two rotatable elements 5, 23 may be parallel to one another, as can be seen from FIGS. 6 and 11, and rotate in the same direction.

The static element 24 of the validator 2 comprises a planar support face 31, which is located behind the rotatable validator element 23. This planar support face 31 is similar to that of the planar support face 16 of the singulator 1 in that it supports the main faces of money items as the money items are conveyed around the axis of rotation 6 by the conveying surfaces 25 of the rotatable validator element 23. The planar surfaces 16, 31 of the singulator 1 and validator 2 may be parallel to one another.

The conveying surfaces 25 of the validator 2 may be aligned with the conveying regions 7 of the singulator 1 so that singulated money items which pass through the aperture in the exit region 22 in the planar support surface 16 of the singulator 1 are immediately collected and conveyed forwards by a conveying surface 25 of the validator 2. Thus the conveying surfaces 25 of the validator and the conveying regions 7 of the singulator at least substantially overlie one another for at least the major part of the surface area that they sweep over on rotation of the element 5 and element 23. The general configuration of the conveying surfaces 25 of the validator 2 is optimised for money item pick-up and conveyance. For example, the height of the conveying surfaces 25 may be several times that of the thickness of the money items intended to be conveyed, such as between approximately 3 mm and 6 mm. This is possible because the singulation of the money items has already been carried out separately in the singulator 1.

As illustrated in FIG. 11, the arms 29 of the rotatable validator element 23 may each include a plurality of upstanding projections 41. The upstanding projections 41 extend towards the planar support face 16 of the static element 15 of the singulator 1 and away from the planar support face 31 of the static element 24 of the validator 2. The upstanding projections 41 ensure that money items in the conveying regions 28 of the rotatable validator element 23 cannot pass over the top of the arms 29 into an adjacent conveying region 28. The spacing of the upstanding projections 41 is significantly less than the diameter of the smallest diameter money item to be validated, so that the money items cannot fit between, or around the outside of, the projections 41.

The upstanding projections 41 on the arms 29 of the rotatable validator element 23 may engage with the underside of the static element 15 of the singulator 1. For example, the projections 41 may engage with a recessed track in the underside of the static element 15 of the singulator 1. This ensures that there is no possibility of money items moving between conveying regions 28 of the rotatable validator element 23 by passing over the tops of the projections 41. The engagement may further serve to guide the rotation of the rotatable validator element 23.

In addition to the planar support face 31, the static element 24 of the validator 2 comprises a guide wall 32 for guiding the edges of money items around a conveyance path as they are conveyed by the conveying surfaces 25 of the rotatable element 23. The guide wall 32 is approximately perpendicular to the planar support face 31 and is adjacent to, and concentric with, the outermost edge of the rotatable element 23 at the ends of the arms 29. The guide wall 32 curves around the peripheral edge of the rotatable element 23 so that it surrounds, or partially surrounds, the rotatable element 23. The wall 32 may be approximately circular or may, for example, be an arc of a circle. In either case, the curve of the wall 32 is centred on the same axis of rotation as the rotatable element 23 of the validator 2.

The radius of the wall 32 is slightly larger than the largest radius of the rotatable element 23, which means that the edges of money items located in the outermost parts of the conveying regions 28 are in contact with the wall 32 as they are conveyed by the conveying surfaces 25 around the axis of rotation. The contact between the edges of the money items and the wall 32 guides the money items along the path of the wall 32 as the money items are conveyed by the conveying surfaces 25 of the rotatable element 23.

Adjacent to the lowest point of the rotatable validator element 23 there may be provided one or more debris release apertures 33 through which small items of debris which have found a way into the validator 2 may be released. This release apertures 33 may be similar to the corresponding aperture 19 in the singulator 1 described previously. The debris release apertures 33 may be connected to the same debris exit chute as the aperture 19 in the singulator 1 so that items of debris are directed out of the pay-in module 3 under gravity. As with the singulator 1, the elimination of debris from the validator 2 is aided by the provision of a guide channel 34 around the outside of the rotatable validator element 23. The guide channel 34 may be provided in the form of a small gap between the outer edge of the rotatable validator element 23 and the guide wall 32 of the static element 24. The guide channel 34 allows items of debris to fall to the release apertures 33 without being continuously disturbed by rotation of the rotatable element 23. The width of the gap may be less than the radius of the smallest diameter money item to be validated. If the money items are world coins, an example gap width may, for example, be less than 7 mm, such as between 2 mm and 7 mm, because the smallest world coin presently has a diameter of approximately 14 mm. As will be described in more detail below, the debris release aperture 33 of the validator 2 may be accompanied by a controllable gate 35. The gate 35 may be opened to release debris through the aperture 33.

In a similar manner to the corresponding surfaces of the singulator 1, the guide wall 32 and the conveying surfaces 25 of the rotatable validator element 23 may support money items in stable locations relative to the rotatable element 23 during rotation of the element 23 around the axis of rotation. The stable locations provided by the combination of the conveying surface 25 of each conveying region 28 and the guide wall 32 retain the singulated money items against the guide wall 32 during the first stage of the rotation path, meaning that the position of the money items during the first stage of the rotation path is highly predictable and can thus be relied on for the purposes of performing sensory checks for validation.

The money item sensors 26 may be located at a fixed point on the rotation path of the rotatable validator element 23 so that the money items are conveyed past the sensors 26. For example, referring to FIG. 11, one or more optical sensors 26A may be arranged to view the money items being conveyed in the conveying regions 28 from a location directly above the rotation path of the rotatable validator element 23. The optical sensors 26A may therefore be located on the opposite side of the rotatable element 23 to the planar support face 31 of the static validator element 24. The optical sensors 26A are configured to detect properties of the money items as they are conveyed past the sensors 26A against the guide wall 32. The optical sensors 26A may, for example, be configured to detect the diameter of the money items so that the detected diameter can be checked against the stored diameters of genuine money items to enable the money items to be validated.

Additionally or alternatively, the sensors 26 may comprise one or more electromagnetic sensors 26B. If used in combination with the optical sensors 26A referred to above, the electromagnetic sensor(s) 26B may be located in a similar, but different, point on the rotation path to the optical sensors 26A. Both the optical and electromagnetic sensors 26 may be located in the first stage of the rotation path, in which the money items are driven along the guide wall 31 in the outermost part of the conveying regions 28. The first stage of the rotation path may correspond approximately to the part of the rotation path in which the innermost end of the trailing edge 27 of each conveying region 28 is higher than the outermost end of the trailing edge 27.

The electromagnetic sensor(s) 26B are configured to produce an electromagnetic field through which the money items pass as they are conveyed along the guide wall 32. For example, the one or more electromagnetic sensors 26B may each comprise an oscillator, such as an electrical oscillator circuit, which oscillates at a frequency which is dependent on the characteristics of a money item sensing element of the sensor 26A. The money item sensing element has electrical characteristics which are temporarily varied by the electromagnetic effect of money items, such as coins, as the money items move along the guide wall 32 past the sensor(s) 26A. The exact nature of the variation is related to the properties of the money item. Any suitable oscillator circuit may be used. Examples include oscillator circuits in which the money item sensing element is an inductive element, such as in LC and RL oscillator circuits. The inductive element may comprise one or more inductive coils or other windings. Another example is an oscillator circuit in which the money item sensing element is a capacitive element, such as in RC oscillator circuits. The capacitive element may comprise one or more capacitors.

Signals from the sensors 26, which are indicative of the detected characteristics of the singulated money items, are fed to a controller 36, such as an electronic microcontroller, of the pay-in module 3 or wider money item handling system. The controller 36 may be configured to determine the authenticity and/or value of the singulated money items from the output signals. The controller 36 may, for example, be configured to analyse the signals, for example by comparing the signal characteristics to known money item characteristics stored in a memory 37 of the pay-in module 3.

Figure 12:
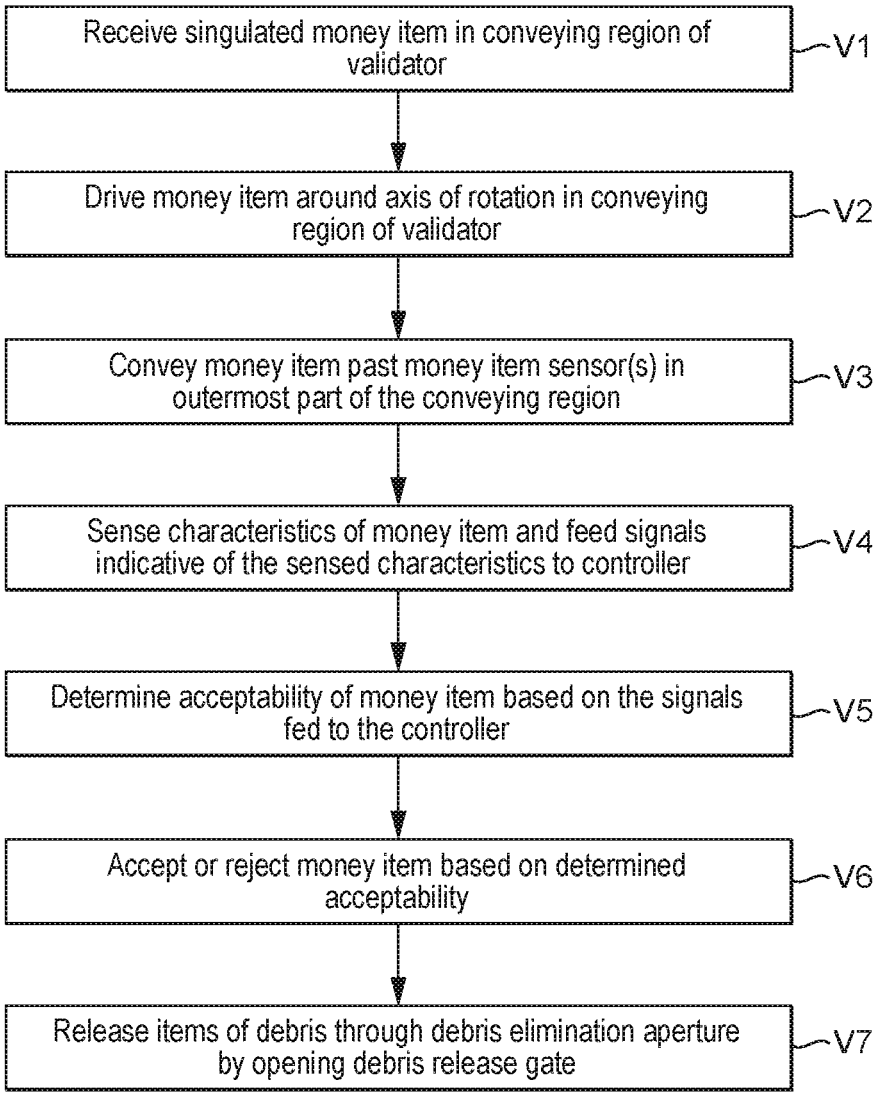
FIG. 12 is a flow diagram illustrating a set of steps for validating singulated money items using a rotary money item validator.

An example operation of the validator 2 is described below with reference to FIG. 12. It will be appreciated that the steps described below in relation to the validator 2 may follow the singulating steps that have already been explained with respect to FIG. 9.

In a first validating step V1, a singulated money item is received in a conveying region 27 of the validator 2. The money item may have been singulated in the singulator 1 described above and may enter the validator 2 through the aperture in the exit region 22 of the planar support face 16 which divides the singulator 1 from the validator 2 in the bulk entry pay-in module 3. The money item lies flat between the leading edge 30 and the trailing edge 27 of the conveying region 28, with its main faces parallel to the planar support face 31 of the static element 24 of the validator 2.

In a second validating step V2, the money item in the conveying region 28 may be conveyed around the axis of rotation by a driving force exerted by the conveying surface 25 against the edge of the money item. The rotation of the rotatable element 23 of the validator 2 may be driven by the same drive unit 8 that drives rotation of the rotatable element 5 of the singulator 1. As the rotatable elements 5, 23 of both the singulator 1 and the validator 2 are fixed to the same axis of rotation and rotate synchronously with each other, the rotation of the rotatable validator element 23 is triggered by the same stimulus that triggers rotation of the rotatable singulator element 5.

In a third validating step V3, the money item is conveyed in a stable and predictable location in the outermost part of the conveying region 28 past the money item sensors 26 described above.

In a fourth validating step V4, the money item sensors 26 sense characteristics of the money item such as its size and material composition and generate output signals which are indicative of the sensed characteristics. The generated output signals are fed to the controller 36 for analysis.

In a fifth validating step V5, the controller 36 determines whether the output signals from the sensors 26 indicate that the money item is acceptable. As described previously, this may comprise comparing the money item characteristics indicated by the output signals with known money item characteristics stored in a memory 37 of the pay-in module 3.

In a sixth validating step V6, having determined whether the money item is acceptable, the controller 36 is configured to cause an exit gate 38 of the pay-in module 3 to be placed into either an "accept" or "reject" state. The money item is conveyed to the exit gate 38 by the rotatable validator element 23 via an exit aperture in the planar support face 31 of the static element 24 of the validator 2. A portion 31*a* of the support face 31 slopes downwardly to the exit aperture (not visible in FIG. 11) When placed into the "accept" state, the exit gate 38 of the pay-in module 3 directs the money item further into the money item handling system. When placed in the "reject" state, the exit gate 38 directs the money item back to the user via a reject chute.

In addition to the money item validating steps V1-V6 described above, the validator 2 may be configured to carry out a debris elimination step V7 in which the gate 35 at the debris elimination aperture 33 is opened to allow items of debris that have accumulated at the bottom of the planar support face 31 to be released out of the validator 2 through the aperture 33. The step V7 may be carried out either before or after the six steps V1-V6 described above and may be performed when the rotatable element 23 of the validator 2 is not rotating.

Figure 1:
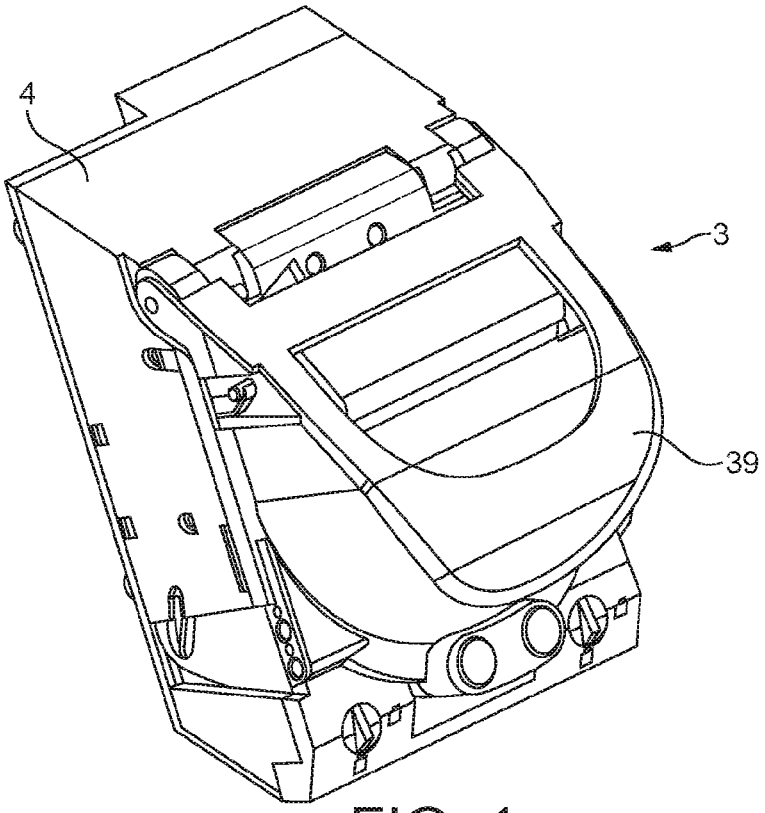
FIGS. 1 to 4 are perspective illustrations of the exterior of a bulk entry pay-in module containing a money item singulator and a money item validator.
Figure 2:
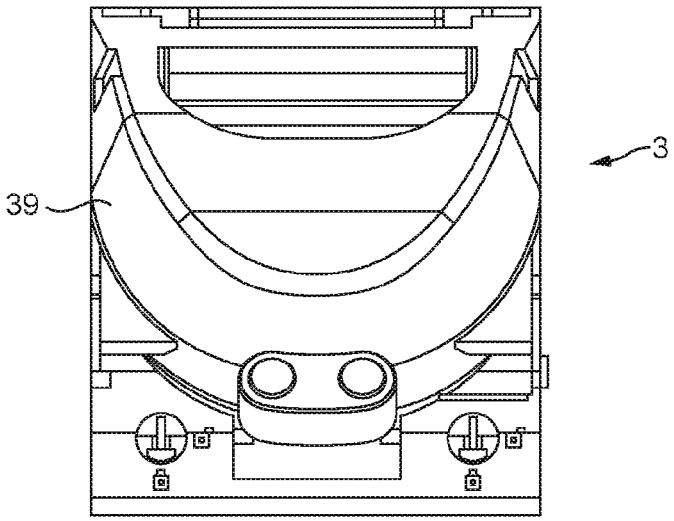
Figure 3:
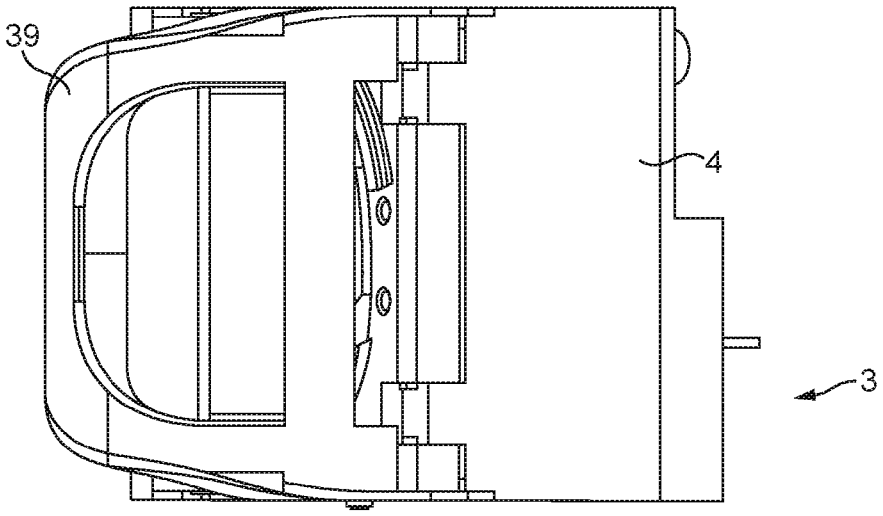
Figure 4:
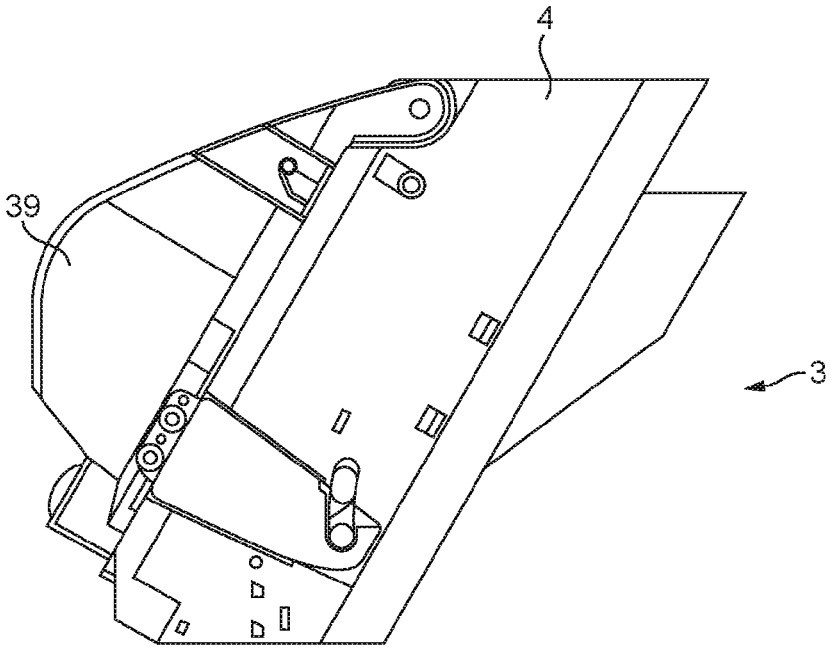
Figure 5:
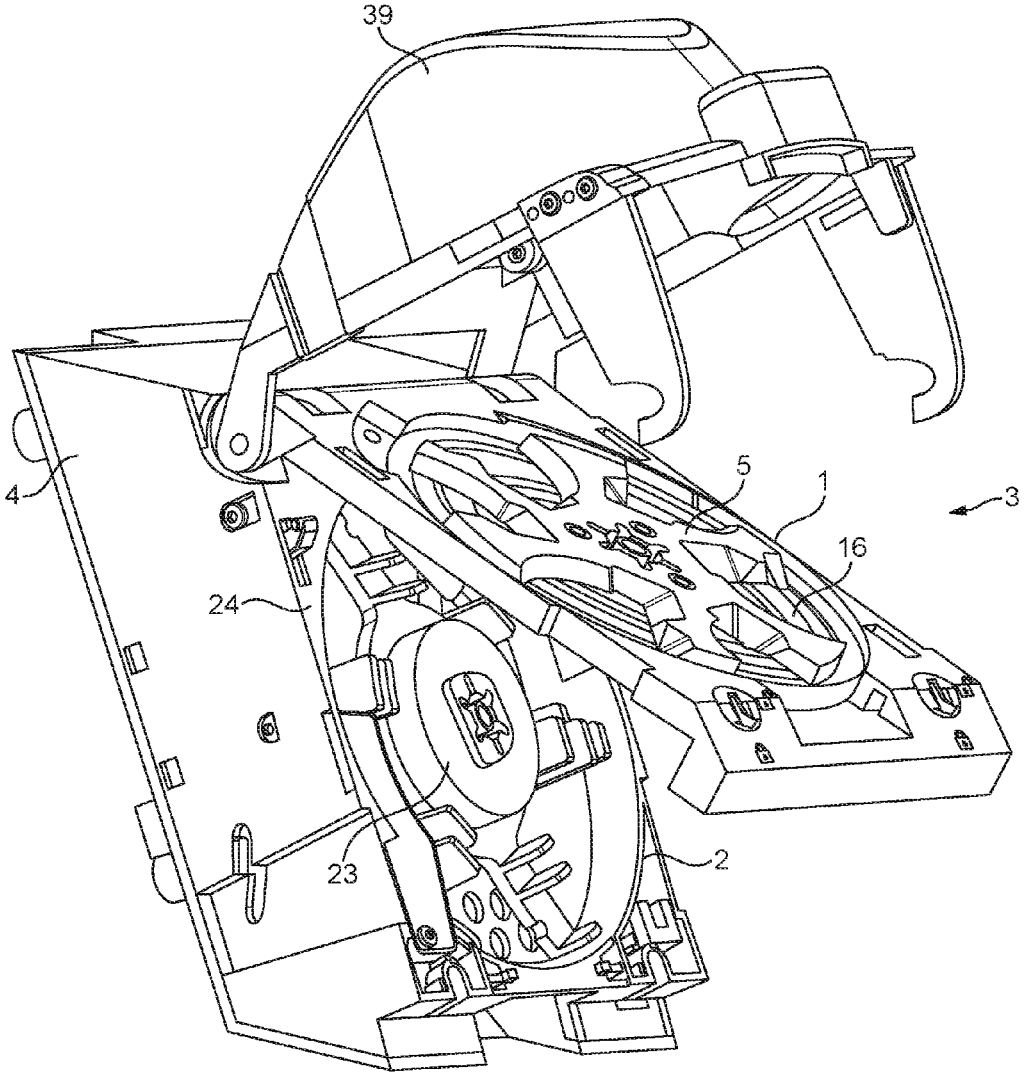
FIG. 5 is an illustration of a partially open bulk entry pay-in module, comprising separate money item singulating and validating elements aligned on the same axis of rotation.

As illustrated in FIG. 5, the external housing 4 of the pay-in module 3 may comprise a front cover 39 which can be opened to provide access to the interior of the module 3. The cover 39 may, for example, be hinged to the rest of the housing 4 to facilitate easy opening and closing. The singulator 1 may be hinged to the housing 4 in a similar manner to the cover 39. For example, FIG. 5 illustrates a situation in which both the cover 39 of the housing 4 and the singulator 1 have been hinged forwards from their normal positions. This facilitates easy access to the validator 2, which during singulation and validation operations is located on the opposite side of the singulator 1 to the cover 39 of the housing 4. As described above, the relative arrangement of the singulator 1 and the validator 2 is such that money items which have been singulated by the singulator 1 can be passed directly to the validator 2 for validation.

The singulator 1 and validator 2 described above may be optimised for singulating and validating the coins of all world currencies. The diameters of these coins currently range between approximately 1.4 mm and 32.5 mm. The different sizes of conveying region 7 described above and illustrated in FIGS. 6 and 7 may aid with singulating all world coins using only a single rotatable singulating element 5. The smaller of the two conveying regions 7 may be optimised for singulating world coins of smaller diameter and the larger of the two conveying regions may be optimised for singulating world coins with larger diameter.

It will be appreciated that although the money item singulator 1 and validator 2 have been described above as components of a bulk-entry money item pay-in module 3 for a money item handling system, the singulator 1 and/or validator 2 could alternatively be used in other components of a money item handling system. It will also be appreciated that it is not necessary to use the singulator 1 and validator 2 together and that, for example, the singulator 1 could be used to singulate money items for purposes other than validation.

Examples of money item handling systems in which the singulator 1 and/or validator 2 may be used include automated payment systems, such as those used in retail locations for self check-outs. Other examples may be found in vending machines or gaming machines. The money items may comprise coins or other disk-like tokens. The money items may be substantially circular, as in the case of coins, and may be metallic.

The invention claimed is:

1. An apparatus, comprising:

a singulator including a rotatable element configured to rotate about a singulator axis to separate money items;

a transfer path through which singulated money items are fed from the rotatable element of the singulator; and a validator including a rotatable element configured to:

rotate about a validator axis;

receive money items from the singulator via the transfer path; and validate the money items;

wherein the singulator axis and the validator axis are substantially aligned with each other.

2. The apparatus according to claim 1, wherein the rotatable element of the singulator is configured to rotate synchronously with the rotatable element of the validator.

3. The apparatus according to claim 1, wherein the rotatable element of the singulator and the rotatable element of the validator are substantially parallel to each other.

4. The apparatus according to claim 1, wherein the singulator axis and the validator axis define a common axis of rotation for the singulator and validator elements.

5. The apparatus according to claim 4, wherein the rotatable elements of the singulator and the validator are fixed to the common axis of rotation.

6. The apparatus according to claim 1, comprising a static element located between the rotatable element of the singulator and the rotatable element of the validator.

7. The apparatus according to claim 6, wherein the rotatable element of the singulator and the rotatable element of the validator are separated by the static element.

8. The apparatus according to claim 6, wherein at least a part of the static element is substantially parallel to the rotatable elements of the singulator and the validator.

9. The apparatus according to claim 6, wherein the transfer path is provided by an aperture in the static element.

10. The apparatus according to claim 1, wherein the rotatable element of the singulator comprises at least one money item conveying region in which money items are singulated during rotation of the rotatable element of the singulator.

11. The apparatus according to claim 10, wherein, during a first stage of a rotation path of the at least one money item conveying region, wherein the at least one money item conveying region is configured to provide a first stable money item location in an outermost part of the at least one money item conveying region.

12. The apparatus according to claim 11, wherein the apparatus comprises a guide wall located adjacent to an outer edge of the rotatable element of the singulator, and wherein the first stable money item location is provided by simultaneous contact of a conveying surface of the at least one money item conveying region and the guide wall with an edge of a money item.

13. The apparatus according to claim 11, wherein, during a second stage of the rotation path of the at least one money item conveying region, wherein the at least one money item conveying region is configured to provide a second stable money item location in an innermost part of the at least one money item conveying region.

14. The apparatus according to claim 13, wherein the second stable money item location is provided by simultaneous contact of a conveying surface of the at least one money item conveying region and a singulating surface of the at least one money item conveying region with an edge of a money item.

15. The apparatus according to claim 14, wherein a height of the singulating surface is not sufficient to support edges of two money items lying face to face in the second stage of the rotation path.

16. The apparatus according to claim 10, wherein the rotatable element of the validator comprises at least one money item conveying region in which money items are validated during rotation of the rotatable element of the validator.

17. The apparatus according to claim 16, wherein the at least one money item conveying region of the validator is configured to receive singulated money items from the at least one money item conveying region of the singulator through the transfer path.

18. The apparatus according to claim 16, wherein the at least one money item conveying region of the rotatable element of the validator is aligned with the at least one money item conveying region of the rotatable element of the singulator so that, during rotation of the rotatable elements, singulated money items pass from a conveying region of the singulator to a conveying region of the validator through the transfer path.

19. The apparatus according to claim 16, wherein, during rotation of the rotatable element of the validator, the at least one money item conveying region of the validator is configured to provide a stable money item location in an outermost part of the at least one money item conveying region.

20. A money item singulator, comprising:

a rotatable money item conveying element with a circumferential surface; and a peripheral guide wall;

wherein the rotatable money item conveying element includes:

at least one money item conveying region comprising an indentation in the circumferential surface of the rotatable money item conveying element, the indentation including a money item conveying surface and a money item singulating surface configured to abut an edge of a money item in the at least one money item conveying region, wherein:

during a first stage of a rotation path of the rotatable money item conveying element, a first stable region for a money item is provided in an outer part of the indentation in the rotatable money item conveying element by the money item conveying surface and the peripheral guide wall; and during a second stage of the rotation path of the rotatable money item conveying element, a second stable region for a money item is provided in an inner part of the rotatable money item conveying element by the money item singulating surface for a money item previously in the first stable region, wherein the second stable region in the inner part of the rotatable money item conveying element supports only a single money item.

* * * * *